United States Patent [19]

Stacey, Jr.

[11] Patent Number: 4,884,502

[45] Date of Patent: Dec. 5, 1989

[54] METAL CONTAINER CRUSHING DEVICE

[76] Inventor: William S. Stacey, Jr., 319 Victory Dr., Franklin, N.H. 03235

[21] Appl. No.: 206,561

[22] Filed: Jun. 14, 1988

[51] Int. Cl.[4] ..... B30B 1/02; B30B 7/04

[52] U.S. Cl. ..... 100/233; 100/293; 100/902

[58] Field of Search ..... 100/35, 42, 280, 293, 100/295, 902, 233, 234, 235, 137, 193, 208, 209

[56] References Cited

U.S. PATENT DOCUMENTS

| | | | |
|---|---|---|---|
| 3,043,212 | 7/1962 | Hasselquist | 100/902 X |
| 3,667,386 | 6/1972 | Workman | 100/233 |
| 3,776,129 | 12/1973 | Carlson | 100/902 X |
| 3,777,659 | 12/1973 | McCarten | 100/902 X |
| 3,980,015 | 9/1976 | Woodard | 100/902 X |
| 3,988,978 | 11/1976 | Flick | 100/902 X |
| 4,212,242 | 7/1980 | Willis | 100/233 |
| 4,292,891 | 10/1981 | Shelley | 100/902 X |
| 4,333,397 | 6/1982 | Modes | 100/902 X |
| 4,345,520 | 8/1982 | Goldsmith et al. | 100/902 X |
| 4,383,480 | 5/1983 | Jerden | 100/902 X |
| 4,498,385 | 2/1985 | Manley | 100/293 X |
| 4,532,861 | 8/1985 | Gisselberg, III | 100/902 X |
| 4,561,351 | 12/1985 | Ader | 100/902 X |
| 4,653,398 | 3/1987 | Fowler | 100/902 X |

FOREIGN PATENT DOCUMENTS

| | | | |
|---|---|---|---|
| 2826207 | 12/1979 | Fed. Rep. of Germany | 100/902 |
| 58-38598 | 8/1983 | Japan | 100/902 |

*Primary Examiner*—Harvey C. Hornsby
*Assistant Examiner*—Scott J. Haughland
*Attorney, Agent, or Firm*—Davis, Bujold & Streck

[57] ABSTRACT

A metal container crushing device comprising a base member and an arm which are each pivotable attached to one another at one end. The arm fixedly supports a compact member adjacent the pivoted end of the arm and a dent member. The compact member includes a lip which, along with the compact surface, captively engages with one end of the container. The metal container crushing device is lightweight and manually operated so that metal containers and the like can be conveniently crushed in a three step operation.

8 Claims, 2 Drawing Sheets

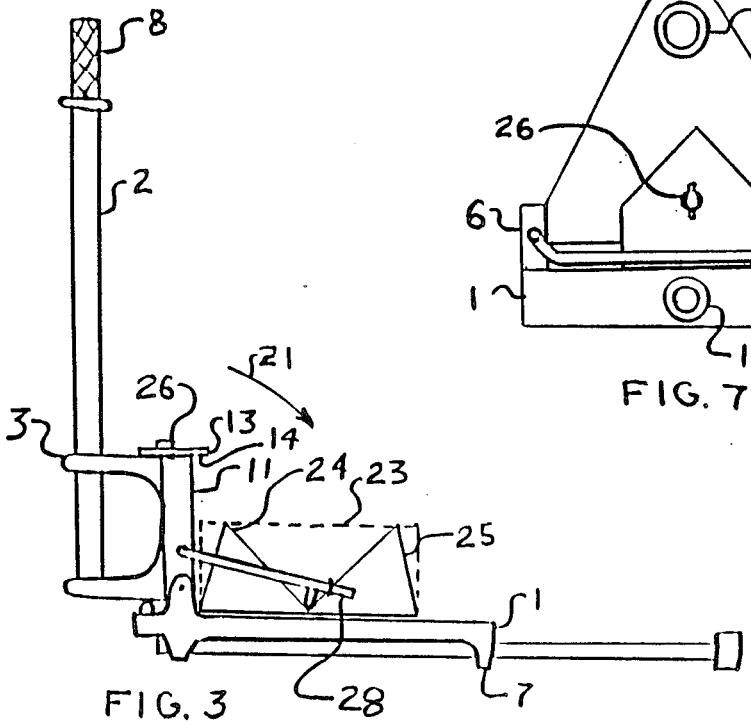
FIG. 3
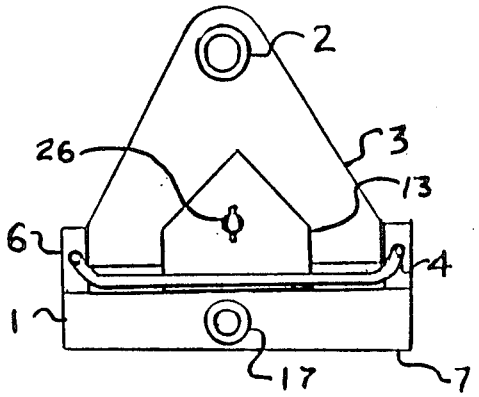
FIG. 7
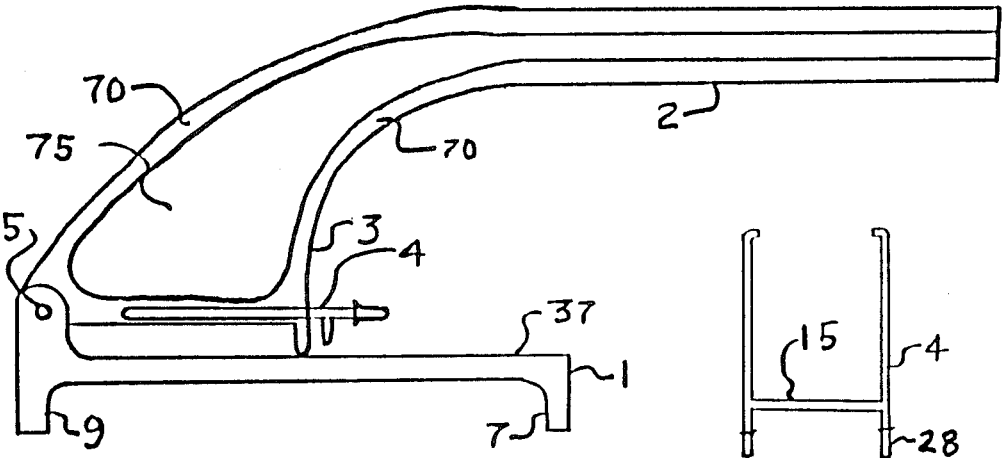
FIG. 8
FIG. 6

METAL CONTAINER CRUSHING DEVICE

This invention relates to a portable and compact metal container crushing device, especially useful in recycling aluminium cans and the like.

BACKGROUND OF THE INVENTION

Consumers are becoming more environmental conscious and are beginning to recycle bottles, cans and paper products in order to conserve energy and clean up the environment. Additionlly, many states have enacted legislation which requires deposits on carbonated beverages contained in bottles and cans to induce consumers of those products to recycle the containers after use. Both of these factors have renewed an interest in finding a relative simple device which make it easier, safer and more convenient for consumers to recycle metal containers, such as aluminium cans and the like.

One of the draw backs associated with recycling aluminium cans is that although they may be very light after they have dispensed their content, they still occupy their original volumn and thus large recycling devices, such as large plastic trash bags or boxes, are needed to conveniently transport the recyclable containers. Moreover, consumers usually collect bottles and cans over long periods of time (usually week or perhaps months) before returning them to a store or a redemption center.

Aluminum cans and the like can be crushed by using conventional means such as a hammer, a rock or just stepping on and crushing the container. However, these crushing methods do not result in a uniformly crushed container and there is a good chance that the person using one of the above means may become injured, and the probability of injury increases if many metal containers are to be crushed.

The aluminium industry projects that in the near future many vegetable, fruit and other products will be packaged in an aluminium containers instead of tin cans, plastic or glass bottles. If and when this occurs, this will substantially increase the demand for a portable, manually operated metal container crushing device which is capable of crushing various shapes and sizes of aluminium containers.

There is presently available manual crushing devices such as U.S. Pat. Nos. 3,667,386, 3,988,978, 4,292,891, 4,383,480, 4,498,385, 5,532,861, 4,561,351, and 4,653,398, which are used in recycling metal containers. However, none of these references disclose a compact surface/lip means arrangement which captively engages only one end of the container to result in a relatively easy three step compaction of the container.

Wherefore, it is an object of the invention is to provide a container crushing device which is manually operated, light weight, portable and easily useable by a consumer.

Another object of the invention is to provide a metal container crushing device which requires a relatively small force to crush and compact a metal container into a flat product.

A still further object of the invention is to provide a unit which is relatively inexpensive to manufacture and maintain.

SUMMARY OF THE INVENTION

Wherefore, one aspect of the present invention is to provide a manually operated metal container crushing device for crushing metal containers comprising a base member and an arm, said arm being pivoted to said base member at one end by hinge means, said arm supporting a compact member adjacent said hinge means, for crushing one half of the container, and supporting dent means spaced from said hinge means, for crushing the center portion of the container, said compact member including lip means located on the side of the compact member furthest away from said hinge means, said lip means and said compact member captively engaging and crushing only one half of the container during a crushing movement of said device.

Another aspect of the present invention is to make the device light weight and easily portable and to reduce the forces required crush a metal container by crushing only one half of the container at a time.

DESCRIPTION OF THE DRAWINGS

These and other objects of the invention may be more clearly understood with reference now being made to the accompanying drawings in which the preferred embodiments of the invention, not drawn to scale, are shown by way of example, wherein

FIG. 3 is a side elevational view of the embodiment shown in FIG. 1 in which the dent is pivoted downward to crush the center portion of a container;

FIG. 6 is a top plan view of the dent shown in FIG. 1;

FIG. 7 is a cross sectional view along lines 1-1 of FIG. 1; and

FIG. 8 is a side elevational view of a second embodiment of the present invention.

Turning now to FIG. 1, one embodiment of the metal container crushing device of the present invention is shown and it includes a base member 1 having arm 2 pivoted at one end of the base member 1 via ears 6, a hinge pin 5 and a compact member 3. It is preferred that the base member 1 include a flat surface 37 having a width of about 4.75 inches and a length of about 5.5 inches. The base member 1 may have an arm extension 17 extending from the end opposite the pivoted end or the base member 1 may be lengthened. It being understood that the base member could have virtually any shape as long as it provides a sufficient flat space on its top surface to accommodate the container to be crushed.

Figure 1:
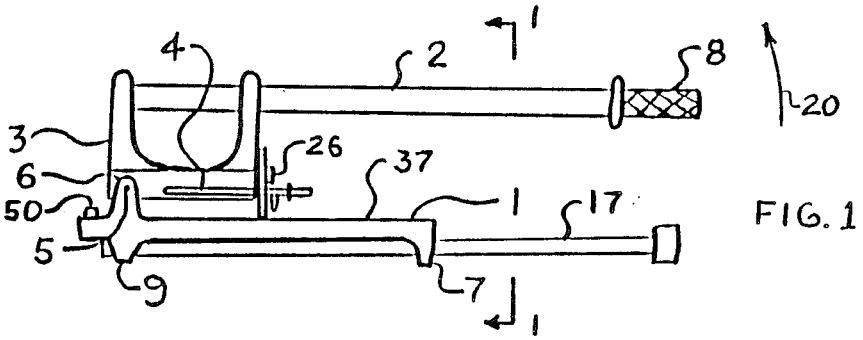
FIG. 1 is a side elevational view of one embodiment of the metal container crushing device of the present invention.
Figure 4:
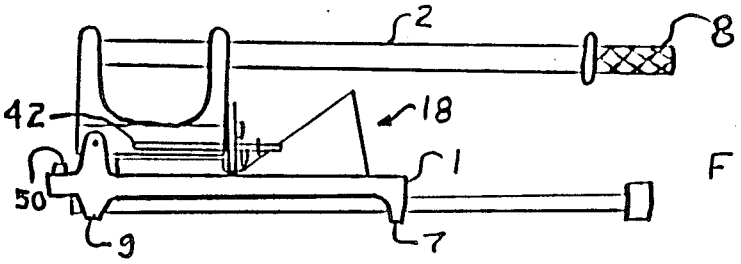
FIG. 4 is a side elevational view of the embodiment shown in FIG. 1 in which the arm is moved to its horizontal position to thereby compact one end of the container.

One feature of the invention is that the arm 2 and the base member 1, when aligned substantially parallel to one another, are sufficiently space from one another so as not to interfer with the crushing movement and to provide an enclosed area for the "crushed" container. It is preferred that when the arm and the base member are in the position shown in FIG. 1, that there is about a 0.38 inch space between the compacting surface 11 of compact member 3 and the top flat surface 37 of the base member 1 to accommodate one end portion of the crushed container. The arm 2 carries hand grip 8 at its non-pivoted end and the compact member 3, at its other end, which is firmly attached to the arm by conventional means and used to pivotably mount the arm 2 to the base member 1. It is preferred that the compacting member 3 have a flat, rectangularly shaped compacting surface 11 which measures about 2.75 inches long and about 4 inches wide. The compact member 3 includes lip member 13, preferably about 2 inches wide (see FIG. 7), which is adjustably attached to the side of the compact member 3 furthest away from ears 6, by bolt 26 or other conventional means, and the purpose and function of the lip member will be more fully explained hereinafter.

A dent 4, typically a U-shape member (see FIG. 6), is pivotably connected to the compact member 3 at a position spaced from hinge pin 5 via two holes 42, one on each side of the compact member 3. The unconnected end of the U-shaped dent 4 has bending surface 15 which is always aligned substantially parallel to base member 1. The purpose and function of dent 4 and bending surface 15 will be more fully explained hereinafter.

The base member 1 preferably is equipped with a front leg support 7 and a rear leg support 9 for supporting the base member 1 on a level surface, such as a table or the like. If desired, the leg supports can be omitted and the device can rest on the bottom surface of the base member.

The operation of the metal container crushing device will now be explained with reference to FIGS. 1–4.

Figure 2:
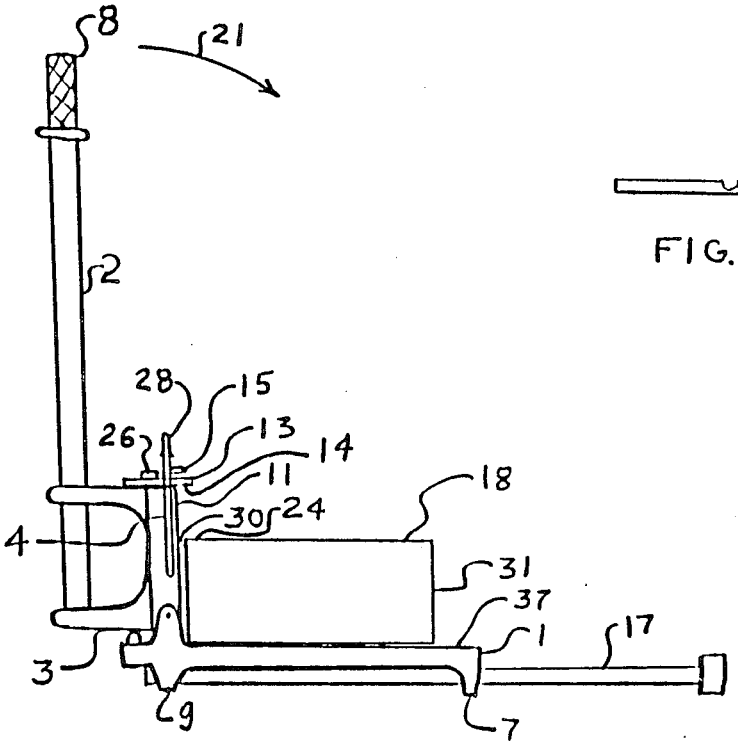
FIG. 2 is a side elevational view of the embodiment shown in FIG. 1 in which the arm is moved to a vertical position.

An operator pivots arm 2 away from base member 1 by moving hand grip 8 upward in the direction of arrow 20 to the position shown in FIG. 2. In this position, the compact member 3 engages a stop member 50, provided on base member 1, to prevent further pivoted movement of arm 2. If desired, the stop member 50 may be omitted. Thereafter, a metal container 18, such as an aluminium can, is placed on the top flat surface 37 of the base member 1 with the longitudinal axis of the aluminium can 18 aligned substantially parallel with the longitudinal axis of the base member. The can 18 is positioned so that one of its end surfaces 30, 31, preferably the top end surfaces 30, is placed adjacent compacting surface 11 of the compact member 3. Then dent 4 is pivoted downward in the direction of arrow 21, by handle means 28, toward the base member 1 so that bending surface 15 engages with the center portion of can 18 and thereby crushes the can transverse its longitudinal axis from the shape shown by dotted line 23 into the shape shown by solid line 25, as can be seen in FIG. 3.

After the center portion is crushed, the dent 4 and bending surface 15 are preferably left in the position shown in FIG. 3 and the arm 2 is then pivoted downward, via hand grip 8, in the direction of arrow 21 to commence crushing of the end 30 of the can 18 adjacent the compact member 3. The dent and bending surface, when in their lowered position, help locate the container 18 and assist in the crimping, folding and flow of the side walls of the container. During this pivoting movement, the end surface 30 of the can abuts against compacting surface 11 of compact member 3 and the top side edge surface 24 of the can abuts against the inner surface 14 of lip member 13. The arrangement of compact member 3 and lip member 13 is such that they captively engage one end 30 or 31 of can 18 as arm 2 is pivoted downward in the direction of arrow 20 to thereby result in complete compaction of the captively engaged end of the can. Thereafter, arm 2 is pivoted upward in the direction of arrow 20 until it abuts stop member 50 and the can 18 is turned 180° on base member 1 so that the bottom end surface 31 of the can is able to engage with compacting surface 11 and be crushed by repeating the above downward pivoting procedure of arm 2.

Figure 5:
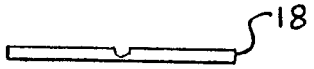
FIG. 5 is a side elevational view of a crushed metal container.

The final compact shape of the container or can 18 is shown in FIG. 5.

An altenate embodiment of the present invention is shown in FIG. 8 wherein the same numbers indicate the same components referred to in the description of FIGS. 1–7, the main difference being that the arm 2, the compact member 3 and the lip member 13 are formed as a unitary member 75 from a high strength plastic material so that it can be easily molded by an injection molding process or the like. This embodiment works essentially the same as the above described embodiment, and, the unitary member 75 may have rib members 70 which provide additional strength to the member. The shape of the unitary member shown in FIG. 8 is not critical so long as the member provides a sufficient crushing surface and lip member arrangement which enable the above captively engaged crushing procedure to be preformed.

It is to be understood that the above dimensions only relate to preferred embodiments of the present invention and variations thereof are still considered within the scope of the present invention. It is preferred that most of the components be made from high strength plastics, aluminium or other lightweight materials to ensure that the device remains lightweight, durable and easily portable. However, the materials selected for the compact member, the lip member and the dent must have sufficient strength to be able to crush the metal container without being fractured or being significantly deformed by the container.

It being understood that certain changes may be made in the above described container crushing device without departing from the spirit and scope of the invention herein involved. It is intended that all matter contained in the above description or shown in the accompanying drawings shall be interperted in the illustrative and not the limiting sense.

Wherefore I claim:

1. A portable, manual metal container crushing device comprising a base member, an arm, compact means and dent means;

said arm being pivoted to said base member at one end by hinge means, the longitudinal axis of said base member and said arm lying in a plane during pivoting movement of said arm relative to said base member, said arm supporting said compact means and dent means adjacent said hinge means, said dent means being pivotably attached to said compact means and providing a bending surface for crushing the center portion of a container transverse the longitudinal axis of the container, and said compact means supporting lip means on a side furthest away from said hinge means, said compact means and said lip means captively engaging and crushing one end of the container and the lips means projecting from the compact means toward the base member during a crushing movement of said arm.

2. The container crushing device of claim 1, wherein said base member and said compact means are made from aluminium.

3. The container crushing device of claim 1, wherein said base member and said compact means are made from high strength plastic.

4. The container crushing device of claim 3, wherein said compact means, said lip means and said arm are formed as an unitary member.

5. The container crushing device of claim 1, wherein the compact means includes a flat crushing surface.

6. The container crushing device of claim 5, wherein said base member includes a flat crushing surface.

7. The container crushing device of claim 1, wherein said dent means comprises a U-shaped member pivotally attached to said compact means.

8. The container crushing device of claim 7, wherein said dent means further includes handle means for pivoting said dent means about said compact means and crushing the center portion of the container when desired.

* * * * *